US008388327B2

(12) United States Patent
Ree

(10) Patent No.: US 8,388,327 B2
(45) Date of Patent: Mar. 5, 2013

(54) PROGRESSING CAVITY PUMP WITH SEVERAL PUMP SECTIONS

(75) Inventor: Sigurd Ree, Loddefjord (NO)

(73) Assignee: AGR Subsea AS, Straume (NO)

( * ) Notice: Subject to any disclaimer, the term of this patent is extended or adjusted under 35 U.S.C. 154(b) by 506 days.

(21) Appl. No.: 12/678,889

(22) PCT Filed: Sep. 18, 2008

(86) PCT No.: PCT/NO2008/000335

§ 371 (c)(1),
(2), (4) Date: Apr. 21, 2010

(87) PCT Pub. No.: WO2009/038473

PCT Pub. Date: Mar. 26, 2009

(65) Prior Publication Data

US 2010/0239446 A1 Sep. 23, 2010

(30) Foreign Application Priority Data

Sep. 20, 2007 (NO) ..... 20074795

(51) Int. Cl.
*F01C 1/10* (2006.01)
*F01C 1/30* (2006.01)
*F04B 17/00* (2006.01)

(52) U.S. Cl. ..... 418/48; 417/410.4; 418/5

(58) Field of Classification Search ..... 418/48, 418/166, 171, 1, 5, 7, 9, 150; 464/106; 166/369
See application file for complete search history.

(56) References Cited

U.S. PATENT DOCUMENTS

| | | | |
|---|---|---|---|
| 1,892,217 | A | 12/1932 | Moineau |
| 2,483,370 | A | 9/1949 | Moineau |
| 2,553,548 | A | 5/1951 | Canazzi et al. |
| 3,499,389 | A | 3/1970 | Seeberger et al. |
| 3,999,901 | A | 12/1976 | Tschirky |
| 4,080,115 | A | 3/1978 | Sims et al. |

(Continued)

FOREIGN PATENT DOCUMENTS

| | | | |
|---|---|---|---|
| DE | 3119568 | A1 | 2/1982 |
| DE | 3712270 | A1 | 10/1988 |

(Continued)

OTHER PUBLICATIONS

U.S. Appl. No. 13/059,425, filed Feb. 17, 2011, Ree.

(Continued)

*Primary Examiner* — Kenneth Bomberg
*Assistant Examiner* — Deming Wan
(74) *Attorney, Agent, or Firm* — Foley & Lardner LLP

(57) ABSTRACT

A progressing cavity pump comprises at least an inner pump rotor enclosed by at least an outer pump rotor so as to collectively form one or more, in principle, separate pump cavities which, according to known geometric principles, will be moved axially through the pump upon bringing the rotors into coordinated rotation. At least two pump sections are disposed therein, each of which comprises one outer pump rotor and one adapted inner pump rotor. The outer pump rotors of all pump sections are fixedly supported and arranged along the same axis, wherein all the inner rotors are supported in fixed positions relative to a pump casing of the pump. The outer rotors of all pump sections are driven by the same motor via at least one differential arranged to allow each pump section to rotate at a mutually different rotational speed.

19 Claims, 5 Drawing Sheets

SECTION A-A

U.S. PATENT DOCUMENTS

| | | | | | |
|---|---|---|---|---|---|
| 4,482,305 | A | | 11/1984 | Nátkai et al. | |
| 4,580,955 | A | * | 4/1986 | Karge | 418/5 |
| 4,585,401 | A | * | 4/1986 | Baldenko et al. | 418/5 |
| 4,592,427 | A | | 6/1986 | Morgan | |
| 4,676,725 | A | | 6/1987 | Eppink | |
| 4,711,006 | A | * | 12/1987 | Baldenko et al. | 29/888 |
| 5,017,087 | A | | 5/1991 | Sneddon | |
| 5,097,902 | A | * | 3/1992 | Clark | 166/187 |
| 5,275,238 | A | * | 1/1994 | Cameron | 166/105 |
| 5,407,337 | A | | 4/1995 | Appleby | |
| 5,588,818 | A | * | 12/1996 | Houmand et al. | 418/5 |
| 5,722,820 | A | | 3/1998 | Wild et al. | |
| 5,807,087 | A | * | 9/1998 | Brandt et al. | 418/48 |
| 5,820,354 | A | * | 10/1998 | Wild et al. | 417/244 |
| 5,988,992 | A | * | 11/1999 | Tetzlaff et al. | 417/360 |
| 6,063,001 | A | | 5/2000 | Suhling et al. | |
| 6,241,494 | B1 | | 6/2001 | Pafitis et al. | |
| 7,300,431 | B2 | * | 11/2007 | Dubrovsky | 606/1 |
| 7,413,416 | B2 | | 8/2008 | Bratu | |
| 2001/0005486 | A1 | | 6/2001 | Wood | |
| 2003/0019682 | A1 | | 1/2003 | Schaedler et al. | |
| 2004/0057846 | A1 | | 3/2004 | Denk et al. | |
| 2005/0169779 | A1 | | 8/2005 | Bratu | |
| 2010/0329913 | A1 | | 12/2010 | Ree | |

FOREIGN PATENT DOCUMENTS

| | | | |
|---|---|---|---|
| DE | 86 17 489 | U1 | 11/1990 |
| DE | 197 15 278 | A1 | 12/1998 |
| EP | 0255336 | A2 | 2/1988 |
| EP | 1400693 | A3 | 3/2004 |
| EP | 1 418 336 | B1 | 5/2004 |
| EP | 1 559 913 | A1 | 8/2005 |
| NO | 327505 | B1 | 7/2009 |
| WO | WO 99/22141 | A2 | 5/1999 |
| WO | WO 2009/035337 | A1 | 3/2009 |

OTHER PUBLICATIONS

U.S. Appl. No. 13/059,427, filed Feb. 17, 2011, Ree.

* cited by examiner

SECTION A-A

PROGRESSING CAVITY PUMP WITH SEVERAL PUMP SECTIONS

SUMMARY

This invention relates to a progressing cavity pump. More particularly, it relates to a progressing cavity pump comprising at least an inner rotor enclosed by at least an outer rotor so as to collectively form one or more, in principle, separate pump cavities which, according to known geometric principles, will be moved axially through the pump upon bringing the rotors into coordinated movement, wherein at least two pump sections are disposed therein, each of which comprises one outer pump rotor and one adapted inner pump rotor, and wherein the pump rotors of all pump sections are fixedly supported and arranged along the same axis, and wherein all the inner pump rotors are supported in fixed positions relative to the pump casing, and wherein the outer pump rotors of all pump sections are driven by the same motor via at least one differential arranged to allow each pump section to rotate at a mutually different rotational speed.

A progressing cavity pump in accordance with the invention is suitable for pumping of multi-phase media, for example oil, water and hydrocarbon gases.

Progressing cavity pumps, also termed PCPs, Mono pumps or Moineau pumps, after the inventor, represent a group of displacement pumps which are commercially available in a number of designs for different applications. In particular, these pumps are popular for pumping high-viscosity media. Typically, such pumps comprise what is normally a metallic screw-shaped pump rotor, hereinafter termed an inner rotor, with Z number of parallel threads, and hereinafter termed thread-starts, Z being any positive integer. In the most common designs, the rotor extends within a cylinder-shaped stator with a core of an elastic material having an axial, through-going cavity formed with (Z+1) internal thread-starts. The pitch ratio between the stator and rotor should then be (Z+1)/Z, the pitch being defined as the length between adjacent thread-crests from the same thread-start.

When the geometric design of the threads of the rotor and stator follows particular mathematical principles, for example those described by the mathematician Rene Joseph Louis Moineau in U.S. Pat. No. 1,892,217, the rotor and stator together will form a number of, in principle, closed cavities continuously moving in the longitudinal direction upon bringing the rotor to rotate, hence the name PCP. For the rotor to rotate about its own axis within the stator, the position of the axis of the rotor will need to rotate about the axis of the stator, but in the opposite direction and at a constant centre distance. Therefore, in pumps of this type there is normally an intermediate shaft with two universal joints arranged between the rotor of the pump and the motor driving it.

The volumetric efficiency of the pump is determined mainly by observing if the, in principle, restricted pump cavities actually remain sealed at the particular rotational speed, pump medium and differential pressure, or if a certain back-flow arises due to the inner walls of the stator yielding elastically, or due to the stator and the rotor being fabricated with a small clearance between the parts. In order to increase the volumetric efficiency, progressing cavity pumps with elastic stators oftentimes are designed with an under-dimensioning in the cavity of the stator, whereby elastic squeeze fit exists. However, this squeeze fit must be balanced against the desire for moderate friction and heating.

Although little known and hardly widespread industrially, but nevertheless described already in said U.S. Pat. No. 1,892,217, are special designs of progressing cavity pumps in which a part, similar to the one termed stator above, is caused to rotate about its own axis in the same direction as the internal rotor. In this case, the part with (Z+1) internal thread-starts more correctly may be termed an outer rotor. At a fixed speed ratio between the outer rotor and the inner rotor, the inner rotor as well as the outer rotor may be mounted in fixed rotary bearings, provided the rotary bearings for the inner rotor have a correct axle distance or eccentricity measured relative to the central axis of the outer rotor. Hitherto, advantages of such designs have received little attention, however they comprise fundamentally reduced imbalance and minimal vibrations in the pump, increased operational rotational speeds, increased capacity, and a flow pattern changed from helical to rectilinear, hence having a reduced emulsification tendency.

The proliferation thereof has probably been restricted by challenges associated with the dynamic seals of the outer rotor and rotary bearings having relatively large diameters and peripheral speeds, which are avoided completely when a stator is used. On the other hand, an intermediate shaft and a universal joint may be avoided when the stator is replaced with an outer rotor.

U.S. Pat. No. 5,407,337 describes a progressing cavity pump (termed a "helical gear fluid machine" herein), wherein an outer rotor is fixedly supported in a pump casing, wherein an external motor has a fixed axis extending through the external wall of the pump casing parallel to the axis of the outer rotor in a fixed eccentric position relative thereto, and wherein the motor's axis through a flexible coupling drives the inner rotor having, besides said coupling, no other support than the walls of the helical cavity of the outer rotor, the walls of which consist of an elastomer material.

In U.S. Pat. No. 5,017,087 and also in WO 99/22141, Johns Leisman Sneddon has described embodiments of Moineau pumps, wherein the outer rotor of the pump is enclosed by, and fixedly connected to, the rotor of an electromotor having stator windings fixedly connected to the pump casing. In these designs, both the outer and inner rotors of the pump are also fixedly supported in the same pump casing, whereby the outer and inner rotors of the pump together function as a mechanical gear driving the inner rotor at the correct speed relative to the outer rotor, which in turn is driven by said electromotor. These designs are also characterized in that the pump is mountable directly between two flanges on a rectilinear pipeline and, in principle, independently of any further foundation. Such a linear design renders the pump particularly suitable for tackling so-called slugs or growing and accelerating gas pockets in a liquid flow coming from, for example, an oil production well. Whereas impulses from such slugs inflict great mechanical and corrosive loads in conventional PCP inlet chambers having the inlet vertical to the pump axis, slugs within pumps of this design will be utilized positively by the pump rotor, which receives additional torque. At the outlet of the pump, slugs will be approximately neutralized, i.e. the flow speed of all phases will approach the linear speed of the pump cavities.

European patent application EP 1.418.336 A1 discloses a progressing cavity pump provided with a rotor and a stator, wherein the stator of the pump also functions as the stator of an electromotor, and wherein the rotor of the pump also functions as the rotor of the electromotor. This pump will not eliminate the imbalance and vibration in a classic PCP. Rather, and similar to J. L. Sneddon's patents, it will allow the pump to be installed directly between two flanges in a linear pipeline provided it can withstand the vibrations.

A linear arrangement will be of particular interest if the pump is mounted into a freely suspended, vertical underwater pipeline.

Inherent to PCP pumps is that the pump medium is conveyed in closed cavities of fixedly defined volumes. If the pump medium is compressible, pressure build-up through the pump may only occur by virtue of compression of the fluid in the cavity. A possible solution for achieving this may be to design the screw geometry in a manner allowing the cavity to be reduced gradually towards the outlet. This is known from eccentric screw compressors. However, such a solution will be problematic if the fluid composition varies greatly. This is because the pump will be subjected to great loads if temporarily receiving substantially smaller amounts of compressible fluid than designed for.

The alternative is to maintain constant volumes for each cavity over the entire longitudinal extent, and to allow a gradual pressure build-up to be based on a leakage flow from downstream pump cavities. If the leakage flow is moderate, the pressure build-up also becomes slow, and a dominant part of the differential pressure of the pump must build up in the last stage of the pump. This phenomenon provides an interesting advantage in the form of allowing for a smaller discharge to the pump inlet for a multiphase rather than that of an incompressible liquid. This is because the local pressure difference across the first stage becomes smaller. However, a correspondingly larger leakage flow in the last stages causes considerable energy loss and an erosion tendency of the surfaces of the rotors. Attempts of limiting the leakage loss through extra tight fits will further concentrate the pressure build-up to the last stages and will hardly limit the discharge velocity, which largely determines the erosion velocity. At the same time, an increased risk of blocking the rotors of the pump will arise due to wedged-in and hard particles, which may have been introduced together with the liquid flow, or which may have become dislodged from the surface of the rotors due to erosion.

The object of the invention is to remedy or reduce at least one of the disadvantages of the prior art.

The object is achieved by virtue of features disclosed in the following description and in the subsequent claims.

A progressing cavity pump in accordance with the invention comprises at least an inner rotor enclosed by at least an outer rotor so as to collectively form one or more, in principle, separate pump cavities which, according to known geometric principles, will be moved axially through the pump upon bringing the rotors into coordinated rotation, wherein at least two pump sections are disposed therein, each of which comprises one outer pump rotor and one adapted inner pump rotor, and wherein the outer pump rotors of all pump sections are fixedly supported and arranged along the same axis, and wherein all the inner rotors are supported in fixed positions relative to a pump casing, and wherein the outer pump rotors of all pump sections are driven by the same motor via at least one differential for allowing each pump section to have a mutually different rotational speed.

Advantageously, the motor may enclose one or more of the outer pump rotors by virtue of the rotor of the motor having the same rotary axis as that of the outer pump rotors, and wherein the stator of the motor is built into the pump casing.

Advantageously, the rotor of the motor is fixedly supported in the pump casing, and at least one of the outer rotors of the pump may be supported exclusively or partially in the rotor of the motor.

Advantageously, one or more of the pump sections may be provided with a toothed wheel connection or gear structured for ensuring a speed ratio of $Z/(Z+1)$ between the respective outer and inner rotor within the same pump section, and independently of driving contact between an outer thread surface of the inner rotor and an inner thread surface of the outer rotor.

Within each individual pump section, the screw geometry of the inner and outer rotors may be structured in a manner allowing all of the, in principle, closed and separate pump cavities of the same pump section to have the same volume.

The screw geometry may be different from pump section to pump section, and in a manner whereby the volume of each individual, in principle, separate pump cavity becomes smaller from one pump section to the next, as counted from the inlet side. This may compensate for the expected compression of the fluid without changing the rotational speed between the sections, but still in such a way that deviations from the expected compression may be compensated by virtue of different rotational speeds between the sections.

Advantageously, the number of, in principle, separate pump cavities in one pump section may then be smaller than the number of separate pump cavities in the next pump section, as counted from the inlet side, and in a manner whereby an equal hydraulic moment is achieved between the pump sections upon being subjected to approximately the same differential pressure between adjoining pump cavities.

Alternatively, moment balance between the sections may be maintained by virtue of the pitch of the pump rotors increasing from one pump section to the next, as counted from the inlet side. This will prove advantageous if an accelerating flow velocity through the pump is desirable, as in a water jet or fire pump.

Preferably, the direction of rotation of all pump sections may be reversible. This allows for controlled back-flow of fluid, for example in connection with a leakage on the normal downstream side.

In the event of emphasizing low cost, simple logistics and simple maintenance, several pump sections may be identical and interchangeable.

The motor may be disposed on the side of the pump casing and may be demountable, repairable or replaceable without opening or disassembling the very pump, and without leakage of a pump medium to the surroundings taking place.

The pump may be disengaged when dismounting the motor, whereby liquid may flow freely through the pump without leakages and at a moderate pressure drop.

Central to the invention is to distribute the pump's total number of stages, or closed pump cavities, between at least two pump sections in the form of structurally paired inner and outer pump rotors mounted in line one after the other. At least one differential causing the outer pump rotors to automatically adjust to the differences in rotational speeds, which provide for a balanced torque, is arranged between the outer pump rotors. Given that the torque on a rotor of a progressing cavity pump generally is determined by the differential pressure and the geometry, the invention causes the differential pressure to be distributed in a controlled manner if not between all stages, at least between all pump sections. Upon assuming the same pump performance as that of an otherwise corresponding pump without a differential, the motor which drives the pump will have the same moment, but the rotational speed and hence energy requirement of the motor will decrease with increasing compression or gas volume percentage due to the rotational speed decreasing from one pump section to the next. At the same time, the largest local leakage flow and discharge velocity will become smaller so as to cause reduced erosion. Moreover, the pump according to the invention will not be very vulnerable to unforeseen variations in fluid composition. In the event of a larger sand particle or similar getting mixed into the pump flow and blocking one rotor section, a further advantage will be that of harmful shock loads on both the pump and the motor could being reduced by virtue of the moment on the motor, and pump sections being limited by the non-blocked pump sections.

Various exemplary embodiments of the invention also show, among other things, devices for supplying a lubricant to, and protecting differentials from the pump medium if desirable, and also devices for allowing transmission of moment from the one and same motor for the additional operation of the inner rotor, however without requiring a driving contact between the surfaces of the screws of the inner and outer rotors.

In a conventional progressing cavity pump consisting of only one pump section and having constant screw geometry over its entire length, the required shaft power supplied will never be less than the product of the flow volume at the inlet and the overall pressure difference across the pump. This is because the shaft power equals the product of the rotational speed and the moment. The moment is the sum of the friction loss and the hydraulic moment determined unambiguously by the screw geometry and the overall differential pressure across the pump section. The rotational speed is determined by the desired liquid admission, the screw geometry and the discharge on the inlet side (volumetric loss). Upon pumping an incompressible liquid, no difference between the inlet and outlet volumes will exist, and a conventional progressing cavity pump having only one pump section and constant screw geometry over its entire length will operate effectively.

On the other hand, upon pumping a compressible medium, e.g. a mixture of oil, water and hydrocarbon gases, the compression through the pump will render the volume flow at the outlet substantially smaller than the volume flow at the inlet, even though the mass flow is the same. The reduced volume flow at the outlet constitutes a hydraulic power loss, which is converted into undesired heat. At the same time, the internal discharge velocity increases in the pump so as to be broken down more rapidly by erosion.

In the construction of a multiphase booster pump for conveying crude oil to a surface installation from one or more wells having insufficient pore pressure, the gas volume fraction and compressibility of the crude oil may vary considerably over the operating time of the pump, and particularly if the pump is disposed at a seabed junction located at a considerable distance from the reservoir. This indicates a need for a flexible pump in accordance with the invention. The complexity of the pump, however, must be balanced against the operational reliability. Therefore, a compromise is in place when a moderate number of pump sections, perhaps preferably two, as shown in the exemplary embodiment of the attached FIGS. 1-7. This, however, does not prevent the invention from also comprising any number of pump sections assembled for operation via a corresponding number of differentials arranged in accordance with the principles explained in this description. Advantageously, the pump may be used as a downhole booster pump in an oil well, or as a booster pump in a gathering pipeline for several oil wells.

The pump may be flanged directly onto a vertical underwater pipeline.

Upon assembling the pump from several pump sections having one or more intermediate differentials according to the present invention, the scenario of losses resulting from pumping of compressible and inhomogeneous liquids changes significantly. For each individual pump section, the conditions described above still apply. However, in the event of being involved with, for example, two identical pump sections, the pressure difference will be halved for each pump section. The first pump section must then be supplied half the overall power required in the first example. This is because the input flow and rotational speed will be the same. However, if the outlet volume from the first pump section is, for example, halved due to compression, which is not unrealistic, the rotational speed of the next pump section may be halved, thus reducing the overall power requirement of this example by 25%. An even more radical improvement of the energy utilization may take place upon introducing more than two pump sections. This requires correct balancing with respect to the mechanical friction loss consideration, particularly under operational conditions where the gas volume fraction (GVF) at the inlet and/or the ratio between the differential pressure and the inlet pressure is/are particularly large.

The exemplary embodiments described below, which are also shown in the attached figures, are not limiting to the scope of the invention as derivable from the set of claims. Given that it is known to let the outer rotor drive the inner rotor by means of a driving contact between the surfaces in the inner pump cavities, the toothed wheel device driving the inner rotor, as shown in FIGS. 6 and 7, may be omitted completely. Alternatively, a corresponding toothed wheel device for operating the inner rotor, herein only shown on the outlet side, may also be disposed on the inlet side and/or between the pump sections. Naturally, bearings shown as ball and roller bearings may have completely different designs, for example as "tilting pads" or other hydrodynamic bearings, or quite simply as journal bearings. Not the least, dynamic seals will rarely be made as O-rings, but rather as advanced mechanical seals, or at least as lip seals. The high peripheral velocities which may be expected will render natural to consider mechanical seals provided with carbide or diamond contact surfaces.

Given that the fundamental character or functionality of the invention is not changed, any geometric design of an eccentric screw, a rotor and a stator (or outer rotor) known per se, including the geometric relationships deduced by Moineau as well as other developers of prior art PCP pumps, is considered comprised by the present invention. The screw of the inner rotor may have any number of thread-starts provided the outer rotor matches the inner rotor.

Amongst other applications of the invention than those hitherto mentioned remains an option of using the invention for propulsion of vessels by way of water jets. Previously, the use of progressing cavity pumps for this purpose has been pointed out as interesting, but a restriction has been the tendency of the pump to be blocked by objects sucked in together with the sea water. For example, a progressing cavity pump employing several pump sections for this purpose, and in accordance with the invention, may be designed having a mutually decreasing screw diameter or eccentricity from pump section to pump section, however having a correspondingly increasing pitch from the inlet towards the outlet. This design will bring about a gradual acceleration of the liquid from pump section to pump section accompanied by a thrust resulting from the recoil effect. Although effecting the final acceleration most easily by means of a conventional nozzle, the stepped acceleration on the suction side will reduce the risk of cavitation, and the efficiency may become very high given that substantially all of the acceleration also on the suction side is axially directed. The differentials will greatly reduce the risk of a breakdown should drifting objects be drawn in together with the liquid flow. This is because blocking of the first pump section, as far as the motor load is concerned, will be compensated by an increased speed in the next pump section so as to experience a reduced moment due to cavitation, which in this case is favourable. The reduced moment renders the object less wedged in, causing it to do less damage and also to be easier to remove. Upon keeping the nozzle outlet under water, a reversing of the pump will build up pressure between the pump sections. This is because the outflow of liquid through the blocked original inlet section is restrained. Then the moment will increase on all pump sections so as to render fairly probable that the jammed pump section will be released, and the undesired object is pumped out at what is normally considered to be the inlet side. When the object has been removed in a satisfactory manner, the water jet is again ready for normal operation.

BRIEF DESCRIPTION OF THE DRAWINGS

Some preferred exemplary embodiments are described in the following and are depicted in the accompanying drawings, where.

DETAILED DESCRIPTION

Figure 1:
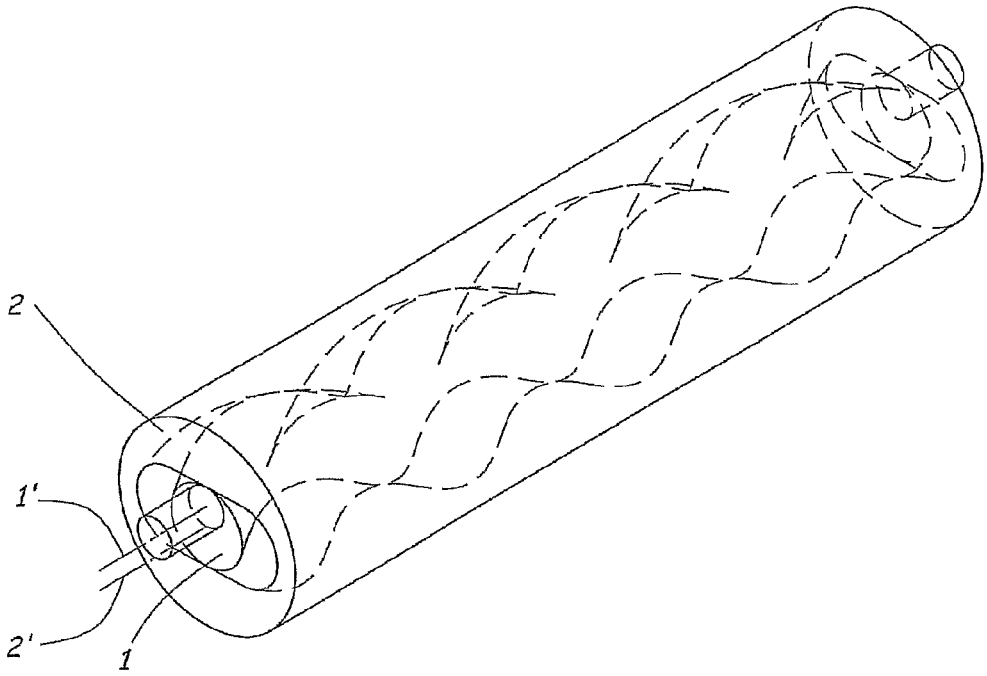
FIG. 1 shows, in perspective, the active components of a progressing cavity pump.

In the drawings, reference numeral P denotes a progressing cavity pump which includes a first pump section Pa and a second pump section Pb.

FIG. 1 shows the active components of a progressing cavity pump P of a type known per se, in which an inner pump rotor 1 extends through a stator or outer pump rotor 2. The inner rotor 1 is formed with one thread-start Z, whereas the stator or outer rotor 2 is provided with Z+1=2 thread-starts.

The centre axis 1' of the pump rotor 1 is positioned at a fixed distance from the centre axis 2' of the stator or outer pump rotor 2.

Figure 2:
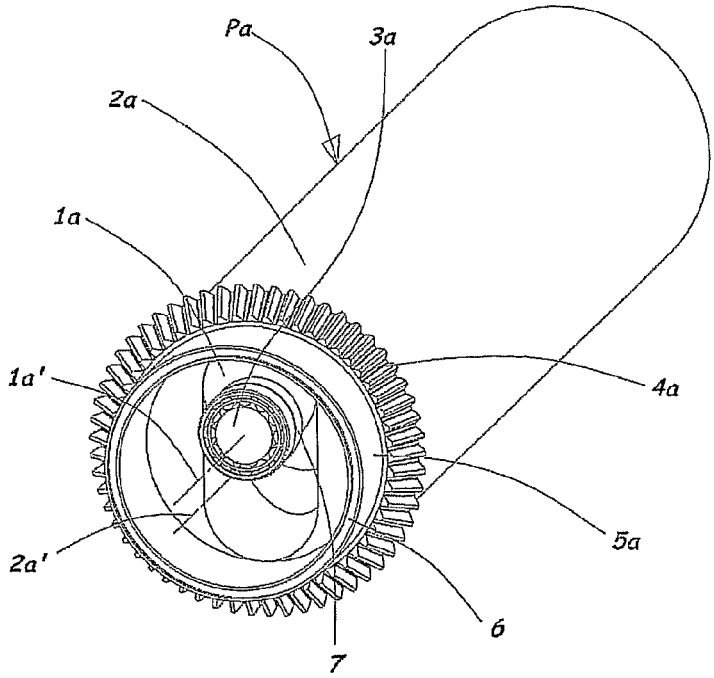
FIG. 2 shows, in perspective, a first pump section according to the invention.

A first pump section Pa of, in principle, two pump sections, the first pump section Pa and a second pump section Pb according to the invention, is shown in FIG. 2. A first outer pump rotor 2*a* with a centre axis 2*a*' is concentrically fixedly connected to a first gear rim 4*a*. In this exemplary embodiment the first outer pump rotor 2*a* is also provided with a concentric first connecting sleeve 5*a* with an enclosing groove 6 for a dynamic seal which isolates the first gear rim 4*a* from contact with the pump medium.

Figure 3:
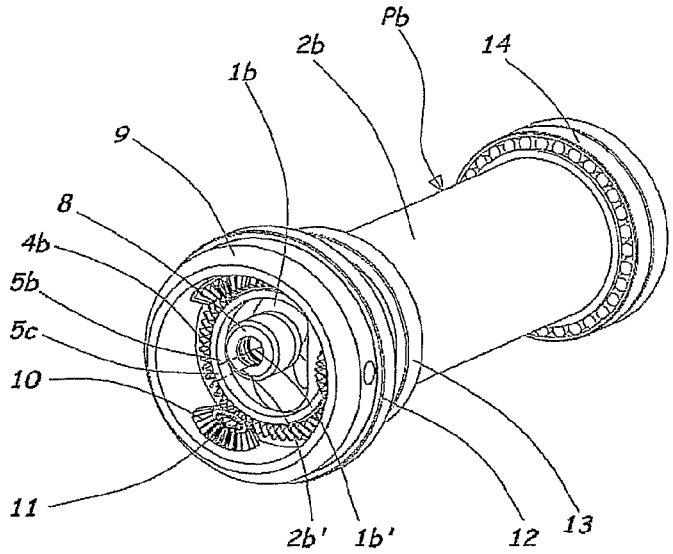
FIG. 3 shows, in perspective, a second pump section according to the invention.

Within the connecting sleeve 5*a* is shown a first inner pump rotor 1*a* with a centre axis 1*a*' which is provided with a first axle journal 3*a*, having, in this case, a rotary bearing 7 shrunk onto it, for example a radial needle bearing, the rotary bearing 7 not being fixed externally in the first pump casing 23 of the first pump section Pa or other solid material, but is fixed in a first bearing housing 8 which is fixedly mounted in the second inner pump rotor 1*b* of the second pump section Pb, see FIG. 3.

Figure 5:
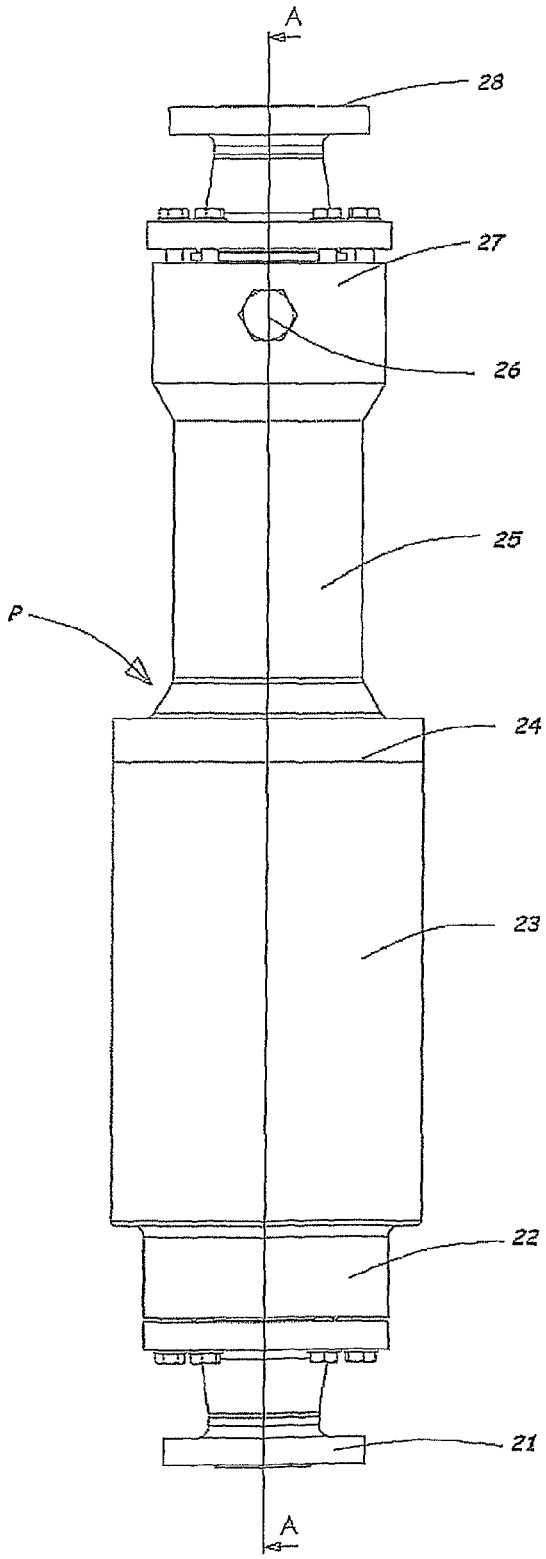
FIG. 5 shows, in a side view, a progressing cavity pump according to the invention.
Figure 6:
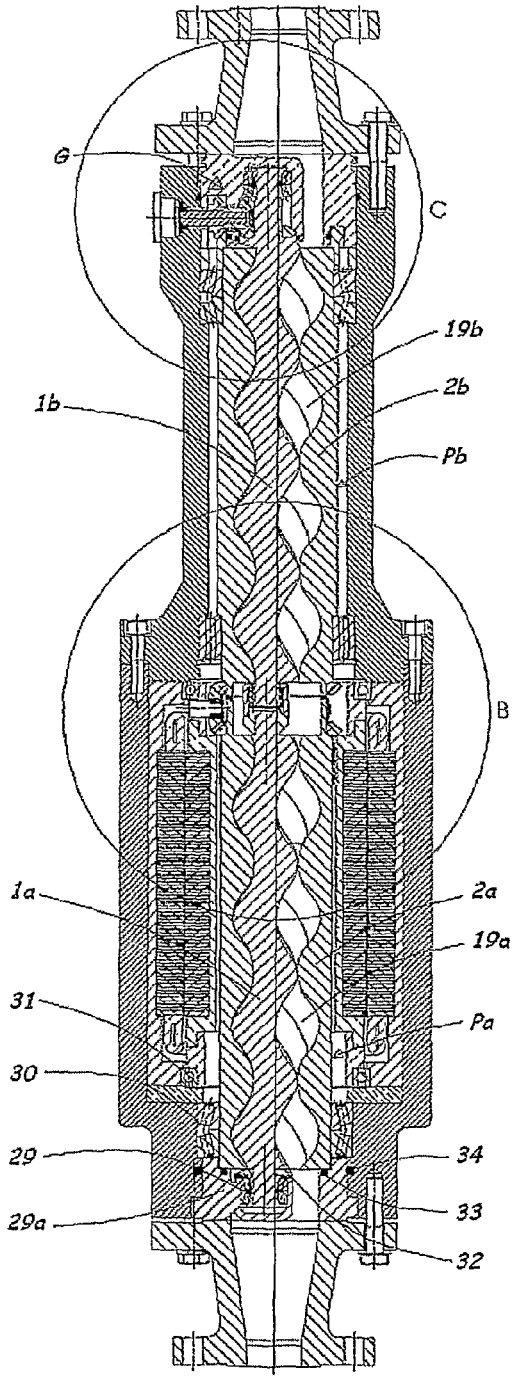
FIG. 6 shows a section A-A from FIG. 5.

The second pump section Pb, see FIG. 3, is mounted concentrically relative to the first pump section, see FIGS. 5 and 6. The second outer pump rotor 2*b* of the second pump section Pb, with a centre axis 2*b*', has a fixedly mounted concentric second gear rim 4*b* with the same reciprocal of the diametral pitch and number of teeth as the first gear rim 4*a* and is mounted at a correct distance therefrom, determined by at least one intermediate planetary gear 10 which is permanently engaged in both gear rims 4*a* and 4*b*. A second connecting sleeve 5*b* is provided with a sealing surface 5*c* which is arranged to cooperate sealingly with the groove 6. Concentrically with its axis 1*b*', the second inner pump rotor 1*b* belonging to the pump second Pb is provided with a shrunk-on first bearing housing 8 which is arranged to fix the rotary bearing 7 so that the centre axis 1*a*' of the first inner pump rotor 1*a* coincides with the centre axis 1*b*' of the second inner pump rotor 1*b*, also by mutually independent rotational speed.

For simplicity, the pump rotors 1*a*, 1*b*, 2*a*, 2*b* are termed rotors below.

The planetary gears 10, which may be of an arbitrary number, rotate freely about their respective axle journals 11, the axle journals 11 being fixedly mounted on a planetary ring 9 in such a way that the axle journals 11 are preferably pointing towards the same point on the central axis 2*b*' of the second outer rotor 2*b*. The planetary ring 9 which rotates about a planetary bearing 12, the planetary bearing 12 being concentric with the rotary bearings 13 and 14 of the second outer rotor, forms together with the first planetary gear 10 and gear rims 4*a*, 4*b* a first differential Da, in which the planetary gears 10 and gear rims 4*a*, 4*b* cooperate in a manner known per se in relation to reciprocal engagement angles, not specified any further, number of teeth etc. The planetary ring 9 is driven, in any manner known per se, by a rotary motor M, termed motor below.

Figure 4:
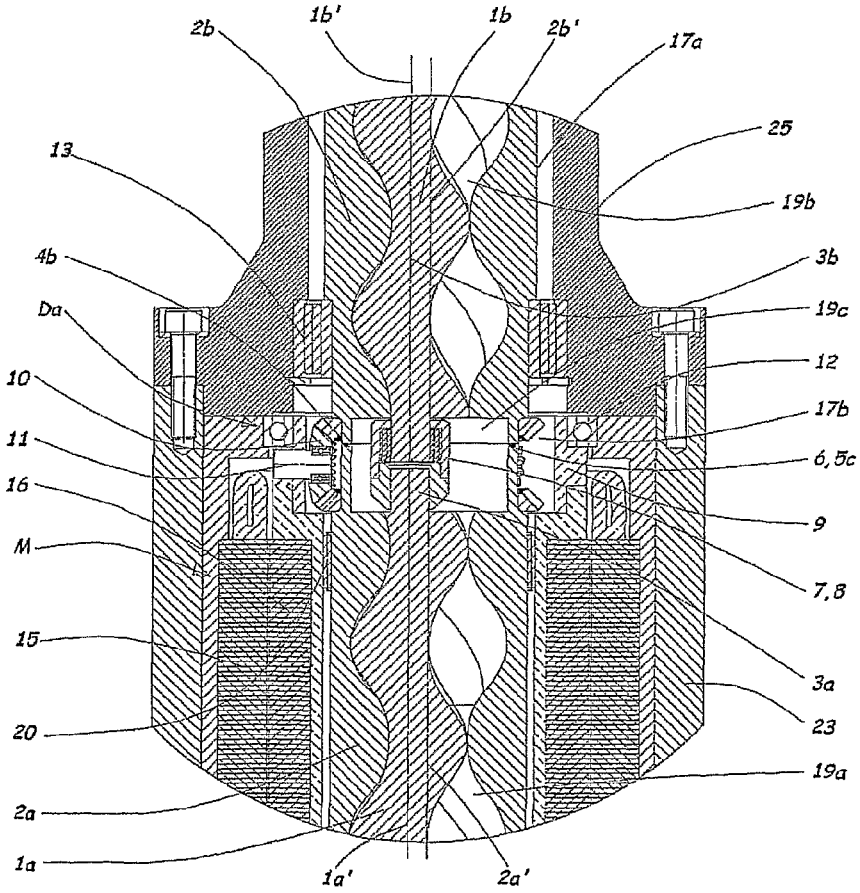
FIG. 4 shows, on a larger scale and in section, a section B from FIG. 6 of a progressing cavity pump according to the invention.

FIG. 4 shows central components from a detail B of FIG. 6. Here, the motor M is constituted by an electromotor which includes a stator 15 and a rotor 16. The rotor 16 of the motor M encloses the first outer pump rotor 2*a* concentrically, though in such a way that the motor M and the first outer pump rotor 2*a* are allowed to rotate relative to each other by means of mutually positioning rotary bearings 20.

In this exemplary embodiment, the rotor 16 of the motor M is fixedly connected to the planetary ring 9, sharing the rotary bearing 12 thereof. The stator 15 of the motor is fixedly connected to the first pump casing 23.

FIG. 4 makes apparent the manner in which the rotation of the motor M and planetary ring 9 drives both outer rotors 2*a*, 2*b* at independent speeds, but in such a way that the first outer rotor 2*a* and the second outer rotor 2*b* will have approximately the same torque, and in such a way that the rotational speed of the motor M corresponds to the mean value of the rotational speeds of the two outer rotors 2*a*, 2*b*.

Figure 7:
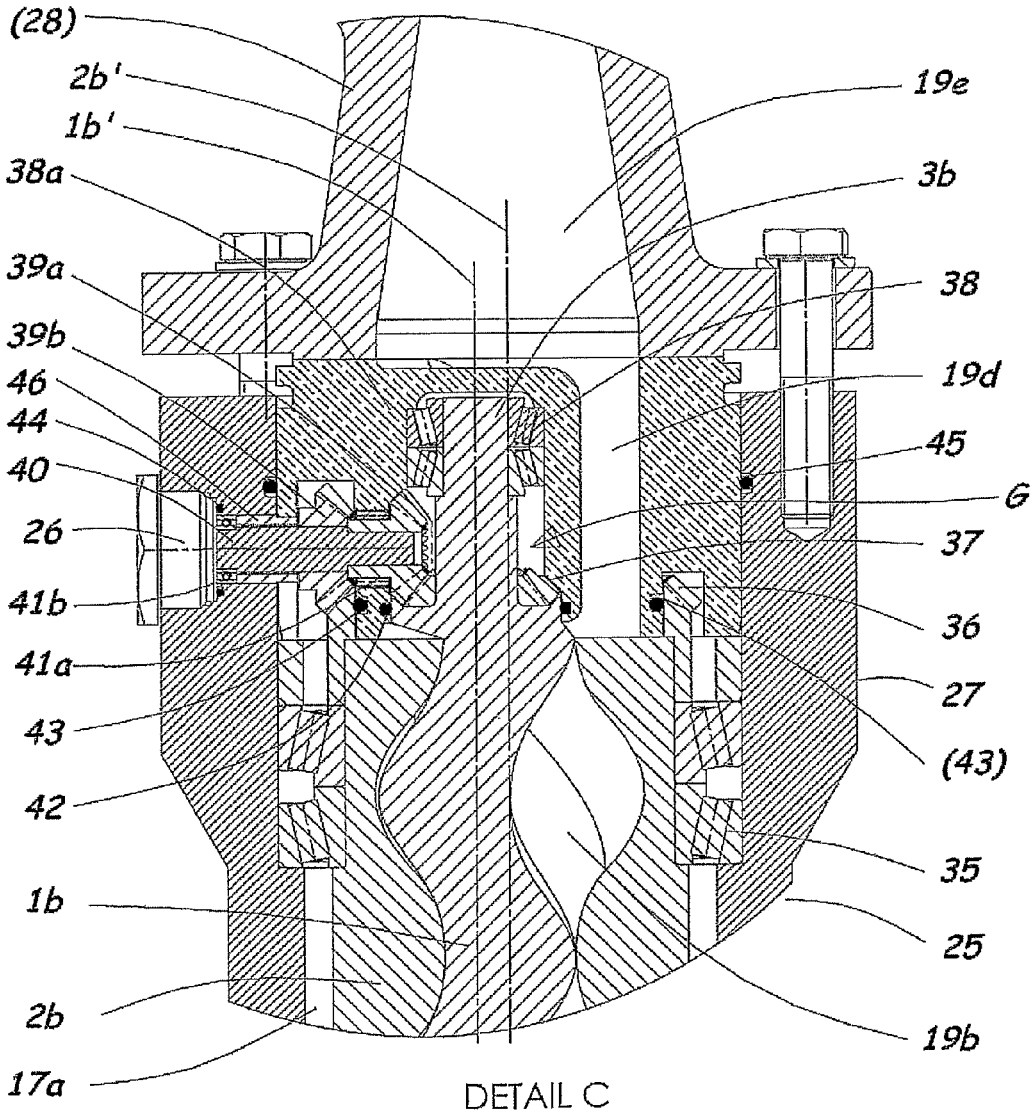
FIG. 7 shows, on a larger scale and in section, a section C from FIG. 6.

The outer rotors 2*a*, 2*b*, on their part, are capable of forcingly controlling the desired rotation of each of their respective inner rotors 1*a*, 1*b* in accordance with known Moineau principles, as both inner rotors 1*a*, 1*b* have coinciding rotary axes 1*a*', 1*b*' but independently rotating axle journals 3*a*, 3*b*, see FIG. 7. The medium to be pumped flows through the pump cavity 19*a* of the first pump section Pa, a cavity 19*c* between the first pump section Pa and the second pump section Pb and further in the pump cavity 19*b* of the second pump section without contact with the bearings 7, 12, 13, 14, or toothed wheels 4*a*, 4*b*, 10 as these are protected by means of, respectively, the tight first bearing housing 8 and the connecting sleeves 5*a*, 5*b* at which the ring 6 cooperates with the sealing surface 5*c*. The toothed wheels 4*a*, 4*b*, 10 and bearings 12, 13, 14, on their part, run in a lubricating and cooling liquid which is carried through, for example, the cavities 17*a*, 17*b* between the outer rotors 2*a*, 2*b* of the pump and the pump casings 23, 25.

FIG. 5 shows in a simplified manner an example of the exterior of a two-stage progressing cavity pump P complete with a motor M, not shown in FIG. 5, and the first differential Da in accordance with the invention. An inlet flange 21 is detachable for access to a bearing housing 22 accommodating a radial and axial bearing 29 (not shown in FIG. 5) for the first inner rotor 1*a* and the first outer rotor 2*a*. The first pump casing 23 accommodates the first pump section Pa (not shown in FIG. 5) as well as the motor M and the first differential Da.

A flange 24 is arranged in order to split the first pump section Pa from the second pump section Pb and to provide access to the motor M and the first differential Da. The second pump casing 25 encases the second rotors 1*b*, 2*b*. An outlet flange 28 is bolted to a bearing housing 27 and arranged to be removed in order to gain access to the bearing 38 of the second inner rotor 1*b* which is placed in a bearing housing 38*a*, and the bearing 35 of the second outer rotor.

In this preferred embodiment, there is arranged a further gear G, see FIG. 7, which is arranged to ensure the correct relative speed of rotation between the second inner rotor 1*b* and the second outer rotor 2*b*, and which thereby reduces the friction loss in the pump P through the disengagement of the otherwise driving direct contact between the second inner rotor 1*b* and the second outer rotor 2*b*. There is access to the axle 40 of the gear G and a first toothed wheel 39*a* and a second toothed wheel 39*b* and bearings 41*a* and 41*b* of the gear G through a plug 26.

FIG. 6 shows a section A-A though the pump of FIG. 5. Here, the area B corresponds to that shown in the section of FIG. 4. Area C, however, corresponds to that shown in the section of FIG. 7.

Here are shown the axial and radial bearing 29 for the first inner rotor 1*a* and an axial and radial bearing 30 for the outer rotor 2*a*, whereas a bearing 31 supports the rotor 16 of the motor M. A fundamental position for a dynamic seal 32 of the bearing housing 29*a* of the first inner rotor 1*a* is shown here in a simplified manner as a simple O-ring. Correspondingly, there are shown an O-ring 34 for statically sealing the motor M and bearings 30, 31 from the surroundings, and, highly simplified, an O-ring 33 in position for dynamically sealing the outer rotor 2*a*.

The section C is shown on a larger scale in FIG. 7, in which the gear G lets the second outer rotor 2*b* drive the second inner rotor 1*b* at the correct speed independently of driving direct contact between the external surfaces of the second inner rotor 1*b* and the internal surfaces of the second outer rotor 2*b*.

A third gear rim 36 is fixedly connected to the second outer rotor 2*b* and fixedly engages the first toothed wheel 39*b* co-rotating with the second toothed wheel 39*a* and the axle 40 in the bearings 41*a*, 41*b*. The second toothed wheel 39*a* drives a third toothed wheel 37 which is fixedly mounted on the axle journal 3*b* of the second inner rotor 1*b*.

In this embodiment, in which the number of thread-starts on the second inner rotor 1*b* is Z=1, the relative number of revolutions of the inner and outer rotors should be (Z+1)/Z=2, which is ensured by $N_{36}/N_{39b}=^{2}*N_{37}/N_{39a}$, in which $N_M$ is the number of teeth of the respective toothed wheel 36, 37, 39*a*, 39*b*. The dynamic seals in positions 42 and 43, shown in a simplified manner as O-rings, separate the pump medium running through the pump cavities 19*b*, a cavity 19*d* at the gear G and an outlet cavity 19*e*, from the bearings 35, 38, 41*a*, 41*b*, and toothed wheels 36, 37, 39*a*, 39*b*. On the other hand, the lubricating and cooling medium in the cavity 17*a* located between the second outer rotor 2*b* and the second pump casing 25 has an open connection to the bearings 35, 38, 41*a*, 41*b*, and the toothed wheels 36, 37, 39*a*, 39*b*, but is isolated from the pump medium as well as from the surroundings by means of static seals 44, 45. A sleeve 46 locks a housing 38*a* which positions the bearing 38 of the inner rotor from being rotatable relative to the second pump casing 25 and bearing housing 27. Please note that, above and below the section shown, there is an open connection between the cavities 19*b* and 19*d* so that here the medium may flow freely even if this does not appear directly from the drawings.

Figure 8:
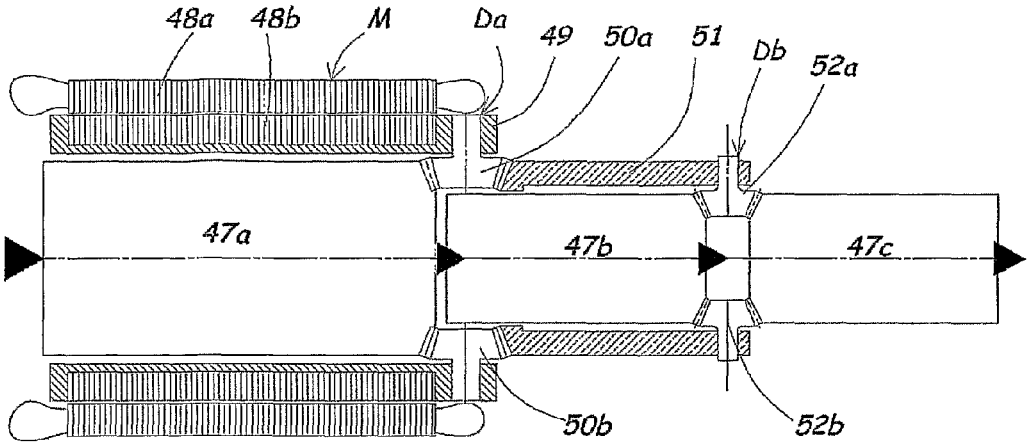
FIG. 8 shows, in an alternative embodiment, a principle drawing of a progressing cavity pump.

FIG. 8 shows schematically, and in principle, an alternative embodiment of a progressing cavity pump P in accordance with the invention with three pump sections 47*a*, 47*b*, 47*c*, in which a compressible medium is assumed to be pumped preferably in the direction of the arrow. In this case, the pump sections 47*b* and 47*c* are identical in pairs, but with inner cavities which are smaller than the cavities of section 47*a*. A first differential Da including a planetary ring 49 and the planetary wheels 50*a*, 50*b* has the effect of balancing the total torque on the sections 47*b* and 47*c* against the torque on section 47*a*. Correspondingly, a second differential Db assembled from the planetary ring 51 and planetary wheels 52*a*, 52*b* will make a balanced torque be exhibited between the sections 47*b* and 47*c*. All the sections are driven by an, in this case, enclosing electromotor M illustrated by a stator 48*a* and a rotor 48*b*.

The smaller cross-sections of the sections 47*b* and 47*c* make the pump function particularly optimally and with not very active planetary wheels 50*a* and 50*b* under specific and presumably normal operating conditions with relatively considerable compression of the pump medium. Still, the pump P will tackle almost equally well temporary operating conditions in which the pump medium is made up of only incompressible liquid. Between themselves, the rotor sections 47*b* and 47*c* will then have the same rotational speed, but this will be greater than the rotational speed of the rotor 47*a*. The planetary wheels 52*a* and 52*b* will now take over the inactive state of the planetary wheels 50*a* and 50*b*, that is, they will not need to rotate about their own axes.

Figure 9:
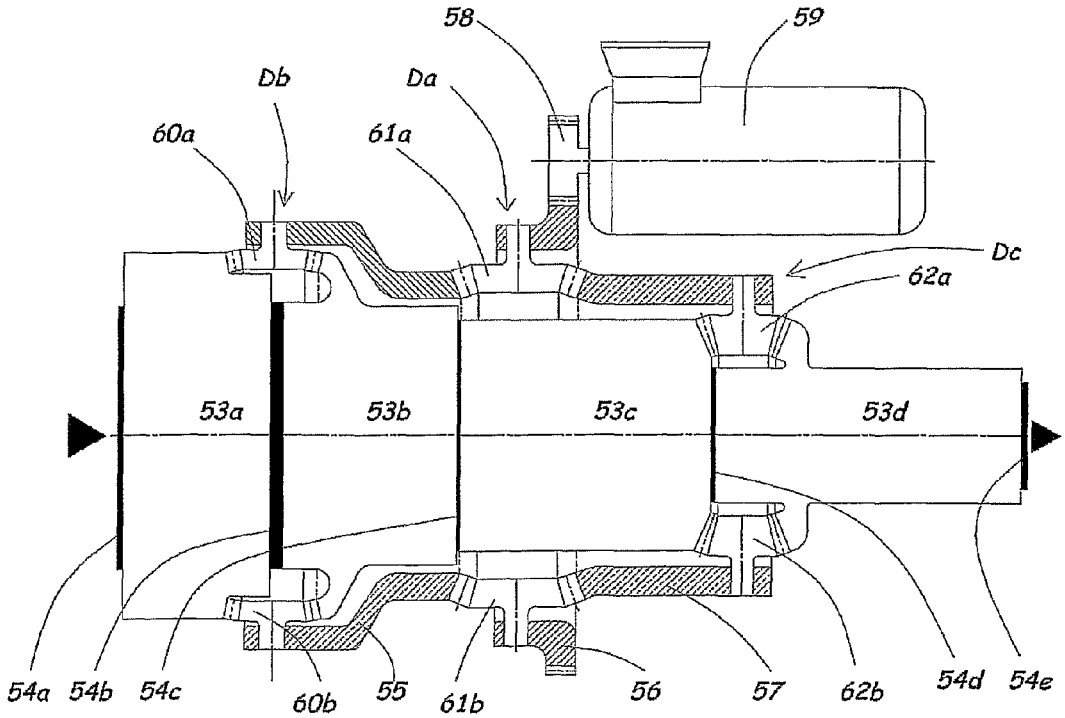
FIG. 9 shows, in a further embodiment, a principle drawing of a progressing cavity pump.

FIG. 9 shows schematically, and compressed in the longitudinal direction, a further exemplary embodiment of a progressing cavity pump P in accordance with the invention. The pump P has been designed with a view to approximately optimal performance over a wide range of gas volume fractions, so that its function can be varied from almost a liquid-only pump to almost a gas-only compressor. The choice was made, in this case, to arrange a motor 59 externally and make it drive as many as four pump sections 53*a*, 53*b*, 53*c*, 53*d* via three differentials. The four pump sections are separated from each other and from the pump casing (not shown) by dynamic seals 54*a*, 54*b*, 54*c*, 54*d*, 54*e*. Within each individual pump section 53*a*, 53*b*, 53*c*, 53*d*, the outer and inner rotors, not shown, are designed in this case with a constant pitch and screw geometry so that all the pump cavities, not shown, within the same pump section maintain the same volume. This is clearly to be preferred when pumping pure liquid. On the other hand, from one pump section to the next the screw geometries are changed, so that for each pump section closer to the outlet the rotor diameter and pitch are reduced while the number of cavities or turns are increased correspondingly, from the principle that each pump section should have approximately the same torque by the same pressure difference per cavity. This principle can be built into the design in a way that will work independently of the gas volume fraction. It assumes an increasing number of revolutions for each pump section 53*a*, 53*b*, 53*c*, 53*d* when an incompressible liquid is pumped, but the same or even a decreasing number of revolutions towards the outlet when the pump medium consists largely of gas.

When the toothed wheel 58 of the motor 59 of the embodiment shown in FIG. 9 drives a first differential Da with the planetary ring 56 and planetary wheels 61*a* and 61*b*, equal torques are ensured on the respective planetary rings 55 and 57 of the two other differentials Db, Dc. Via the planetary wheels 60*a* and 60*b*, the planetary ring 55 brings the pump sections 53*a* and 53*b* to rotate at the numbers of revolutions which between themselves balance the torques best. Correspondingly, the planetary ring 57 will drive the pump sections 53*c* and 53*d* in such a way that they adjust themselves to the numbers of revolutions that balance the torques best.

The invention claimed is:

1. A progressing cavity pump comprising:

a pump casing; and at least first and second pump sections, wherein the first pump section comprises a first outer pump rotor and a first inner pump rotor, and the second pump section comprises a second outer pump rotor and a second inner pump rotor, wherein the first and second inner pump rotors are enclosed by the first and second outer pump rotors, respectively, such that one or more separate pump cavities are collectively formed which are configured to move axially through the pump upon bringing the first and second outer pump rotors in coordinated rotation with respect to their respective first and second inner pump rotor, wherein the first and second outer pump rotors are axially fixedly supported and arranged along a same rotary axis, and the first and second inner pump rotors are supported in axially fixed positions relative to the pump casing, and at least one differential arranged to allow each of the first and second outer pump rotors of the first and second pump sections to rotate at mutually different rotational speeds when driven by a same motor.

2. The progressing cavity pump according to claim 1, wherein the motor is a rotary motor having a motor rotor and a stator, wherein the motor rotor and the first and second outer pump rotors have the same rotary axis such that the rotary motor encloses one or both of the first and second outer pump rotors, and wherein the stator of the motor is built into the pump casing.

3. The progressing cavity pump according to claim 2, wherein the motor rotor is fixedly supported in the pump casing, and wherein at least one of the first and second outer pump rotors is supported exclusively or partially in the motor rotor.

4. The progressing cavity pump according to claim 1, wherein one of the first and second inner pump rotors has Z thread-starts, wherein at least one of the first and second pump sections is provided with a gear structure for ensuring a speed ratio of Z/(Z+1) between the one of the first and second inner pump rotors and its respective outer pump rotor within its respective pump section, and wherein the gear structure is configured to ensure the speed ratio independently of driving contact between an outer thread of the one of the first and second inner pump rotors and an inner thread of its respective outer pump rotor.

5. The progressing cavity pump according to claim 1, wherein the first inner pump rotor and the first outer pump rotor have a first screw geometry such that separate pump cavities of the first pump section have a same volume, and wherein the second inner pump rotor and the second outer pump rotor have a second screw geometry such that separate pump cavities of the second pump section have a same volume.

6. The progressing cavity pump according to claim 5, wherein the first screw geometry is different from the second screw geometry such that the volume of each individual separate pump cavity becomes smaller from one pump section to a next pump section, as counted from an inlet side.

7. The progressing cavity pump according to claim 5, wherein a number of separate pump cavities in one pump section is smaller than a number of separate pump cavities in a next pump section, as counted from an inlet side such that a hydraulic torque becomes approximately the same for both the one and next pump sections upon being subjected to a same differential pressure.

8. The progressing cavity pump according to claim 5, wherein a pitch of the inner and outer pump rotors increases from one pump section to a next pump section, as counted from an inlet side.

9. The progressing cavity pump according to claim 1, wherein a direction of rotation for the first and second pump sections is reversible.

10. The progressing cavity pump according to claim 1, wherein the first and second pump sections are identical and interchangeable.

11. The progressing cavity pump according to claim 1, wherein the motor is disposed outside the pump casing and is configured to be demountable, repairable or replaceable without opening or disassembling the first and second pump sections and without leakage of a pump medium to the surroundings taking place.

12. The progressing cavity pump according to claim 11, wherein the pump is configured to be disengaged when dismounting the motor such that liquid may flow freely through the pump without leakage and at a moderate pressure drop.

13. A method of pumping a medium, comprising:

providing a progressing cavity pump; and wherein the progressing cavity pump comprises a pump casing and at least first and second pump sections, wherein the first pump section comprises a first outer pump rotor and a first inner pump rotor, and the second pump section comprises a second outer pump rotor and a second inner pump rotor, wherein the first and second inner pump rotors are enclosed by the first and second outer pump rotors, respectively, such that one or more separate pump cavities are collectively formed which are configured to move axially through the pump upon bringing the first and second outer pump rotors in coordinated rotation with respect to their respective first and second inner pump rotor, wherein the first and second outer pump rotors are axially fixedly supported and arranged along a same rotary axis, and the first and second inner pump rotors are supported in axially fixed positions relative to the pump casing, and operating the pump by driving the first and second outer pump rotors of the first and second pump sections to rotate at mutually different rotational speeds via a motor and at least one differential operatively located between the first and second pump sections.

14. The method according to claim 13, wherein the step of providing the progressing cavity pump comprises providing the pump as a downhole booster pump in an oil well.

15. The method according to claim 13, wherein the step of providing the progressing cavity pump comprises providing the pump as a booster pump in a gathering pipeline for several oil wells.

16. The method according to claim 13, wherein the step of providing the progressing cavity pump comprises flanging the pump directly onto a vertical underwater pipeline.

17. The method according to claim 13, wherein the step of providing the progressing cavity pump comprises providing the pump in an oil pipeline and arranging the pump such that the pump is reversed immediately upon detection of a downstream leakage in the oil pipeline.

18. The method according to claim 13, wherein the step of providing the progressing cavity pump comprises incorporating the pump into a water jet system for propulsion of a vessel.

19. The method according to claim 13, wherein the step of providing the progressing cavity pump comprises providing the pump as a fire-water pump.

* * * * *